US005947797A

United States Patent [19]

Buzzetti

[11] Patent Number: 5,947,797

[45] Date of Patent: Sep. 7, 1999

[54] COMPUTER-CONTROLLED METHOD FOR POLISHING

[76] Inventor: Mike Buzzetti, 1808 Rambouillet Rd., Paso Robles, Calif. 93446

[21] Appl. No.: 08/922,070

[22] Filed: Sep. 2, 1997

Related U.S. Application Data

[60] Provisional application No. 60/025,906, Sep. 11, 1996.

[51] Int. Cl.[6] ..... B24B 51/00

[52] U.S. Cl. ..... 451/5; 451/11; 451/42; 451/160; 451/384

[58] Field of Search ..... 451/5, 11, 41, 451/42, 158, 159, 160, 278, 384, 389

[56] References Cited

U.S. PATENT DOCUMENTS

| | | | |
|---|---|---|---|
| 5,454,747 | 10/1995 | Ascalon | 451/389 X |
| 5,480,344 | 1/1996 | Xu et al. | 451/42 X |
| 5,558,564 | 9/1996 | Ascalon | 451/389 X |
| 5,720,653 | 2/1998 | Miller et al. | 451/41 X |
| 5,743,787 | 4/1998 | Ishiyama et al. | 451/41 |

*Primary Examiner*—Timothy V. Eley
*Attorney, Agent, or Firm*—Leo F. Costello

[57] ABSTRACT

This invention consists of a process to create and maintain a perfect Figure 8 polishing pattern for polishing fiber optic connector end faces and the apparatus used to perform this process simultaneously on a multiplicity of fiber optic connectors, and similarly configured industrial components.

14 Claims, 2 Drawing Sheets

COMPUTER-CONTROLLED METHOD FOR POLISHING

This Patent Application relates back to the Inventor's Provisional Patent Application filed on Sep. 11, 1996 Application No. 60/025,906.

BACKGROUND OF THE INVENTION

1. Field of the Invention

The present invention relates to a computer program controlled process for creating and maintaining a perfect Figure 8 polishing pattern for polishing fiber optic connectors, and similarly configured industrial components, and the incorporation of this process into a polishing apparatus which simultaneously performs this Figure 8 polishing pattern on a multiplicity of such connectors and components.

2. Description of the Prior Art

The existing state of the art for fiber optic connector polishers is derived from modifications of gemstone polishing machines. These machines consisted of a rotating platter against which the gemstone was moved for polishing. This technique was adopted by the first fiber optic connector polishers, and then modified to their current state, by having a jig, holding no more than 18 connectors, move, in small circles on the rotating platter, while endeavoring, unsuccessfully, to simulate a constant, Figure 8 polishing pattern. The Figure 8 polishing pattern, if it can be perfectly attained and maintained during the polishing operation, provides the optimum method of polishing the end faces of fiber optic connectors in that a perfect Figure 8 pattern produces the most consistent radii and best polish obtainable on these connectors and similarly configured industrial components.

Fiber optic connectors are required in large quantities in the telecommunications and cable TV markets for the manufacture of fiber optic cable assemblies and components. As above noted, current fiber optic connector polishers (a) polish only in a circular pattern which does not polish the face ends of fiber optic connectors as effectively as does a Figure 8 polishing, and (b) these current polishers can polish no more than 18 connectors at one time.

By simultaneously polishing a minimum of 48 fiber optic connectors, or similarly configured industrial components—with the polish being better than any now capable of being obtained in the prior art—this invention will enable the output of polished fiber optic connectors and similar industrial components to be increased three to fourfold over currently employed polishing machines, while reducing significantly the cost of such polishing.

SUMMARY OF THE INVENTION

It is an object of the invention to provide a computer program controlled process for the creation of a uniformly constant, i.e., perfect, Figure 8 polishing pattern which will furnish the optimum quality polishing of a multiplicity of fiber optic connectors, and similarly configured industrial components.

A further object of the invention is the incorporation of the Figure 8 polishing process into a compact polishing machine capable of creating and constantly maintaining a perfect Figure 8 polishing pattern while simultaneously polishing, with optimum quality, at least 48 fiber optic connectors, and similarly configured industrial components, with the layout of the polishing apparatus so constructed as to allow in excess of 48 such connectors or components to be added for simultaneous Figure 8 polishing.

BRIEF DESCRIPTION OF THE DRAWINGS

The present invention will be more fully understood by reference to the following detailed description thereof when read in conjunction with the attached drawings and computer program presentation, and wherein.

DESCRIPTION OF THE PREFERRED EMBODIMENT

Figure 1:
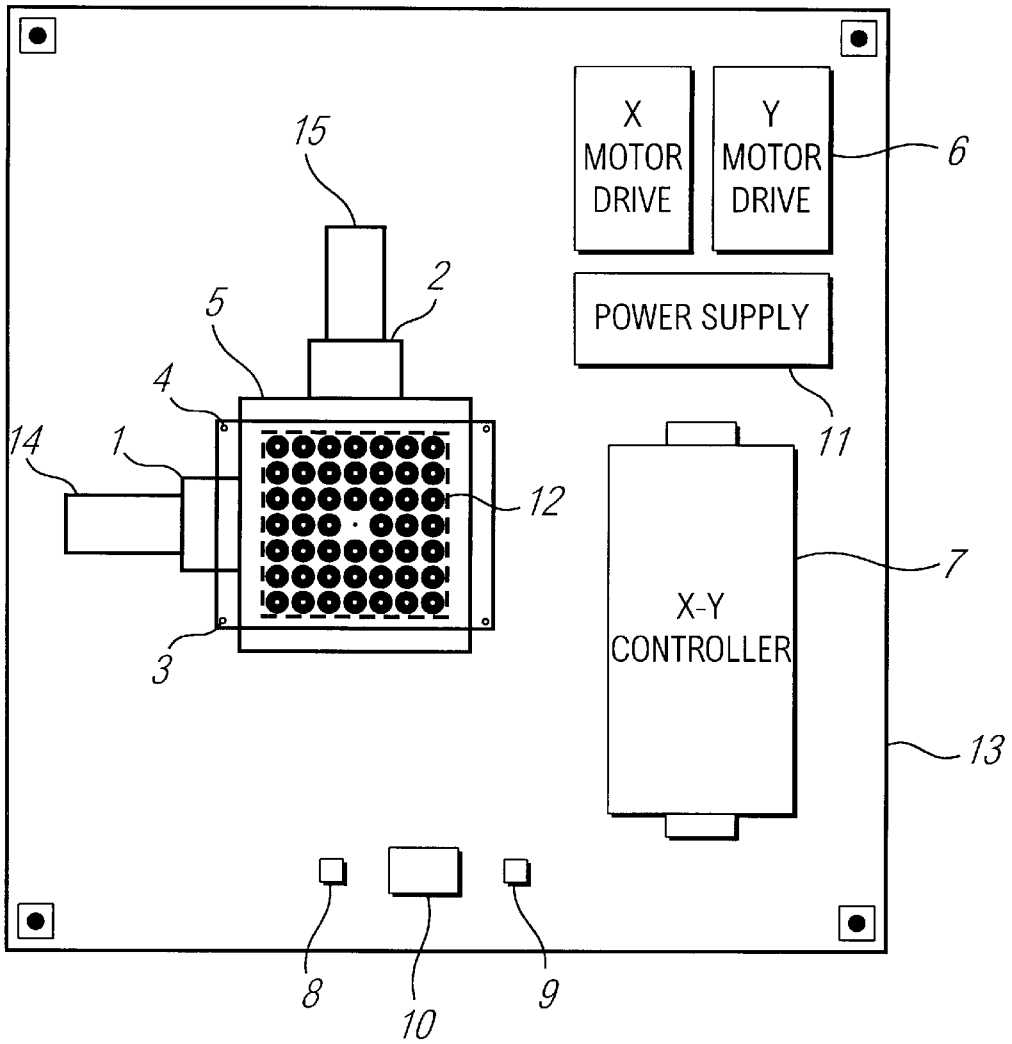
FIG. 1 is a top view of the preferred embodiment of the polisher apparatus portion of the invention.
Figure 2:
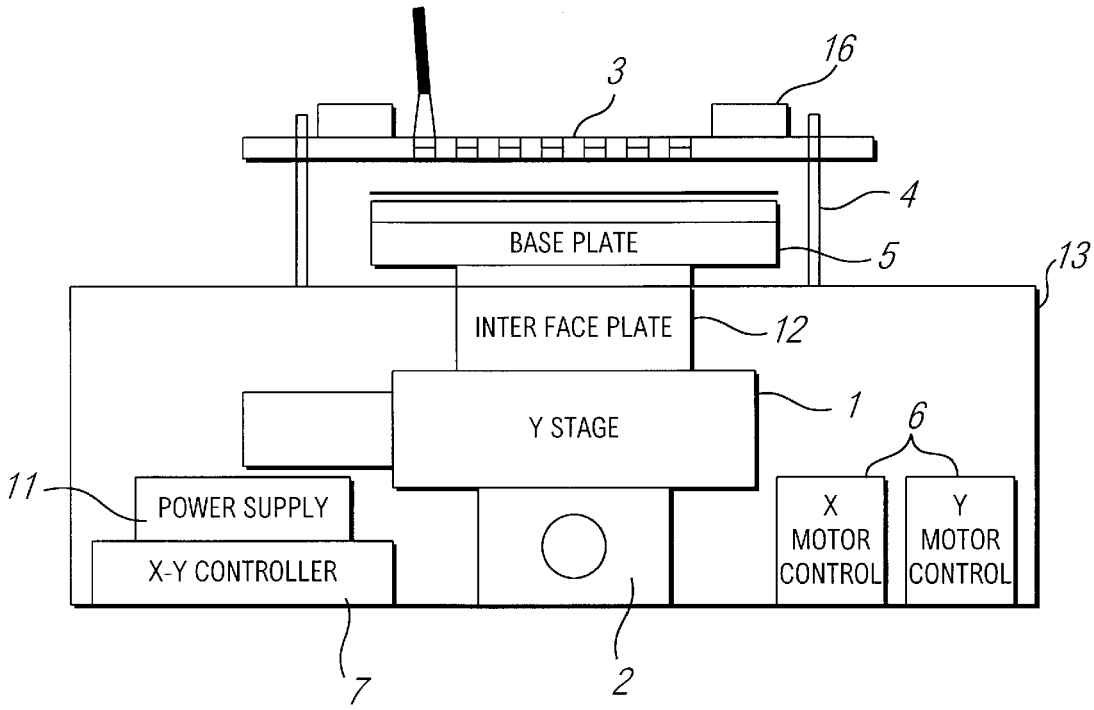
FIG. 2 is a side view of the preferred embodiment of the polisher apparatus portion of the invention.
Figure 3:
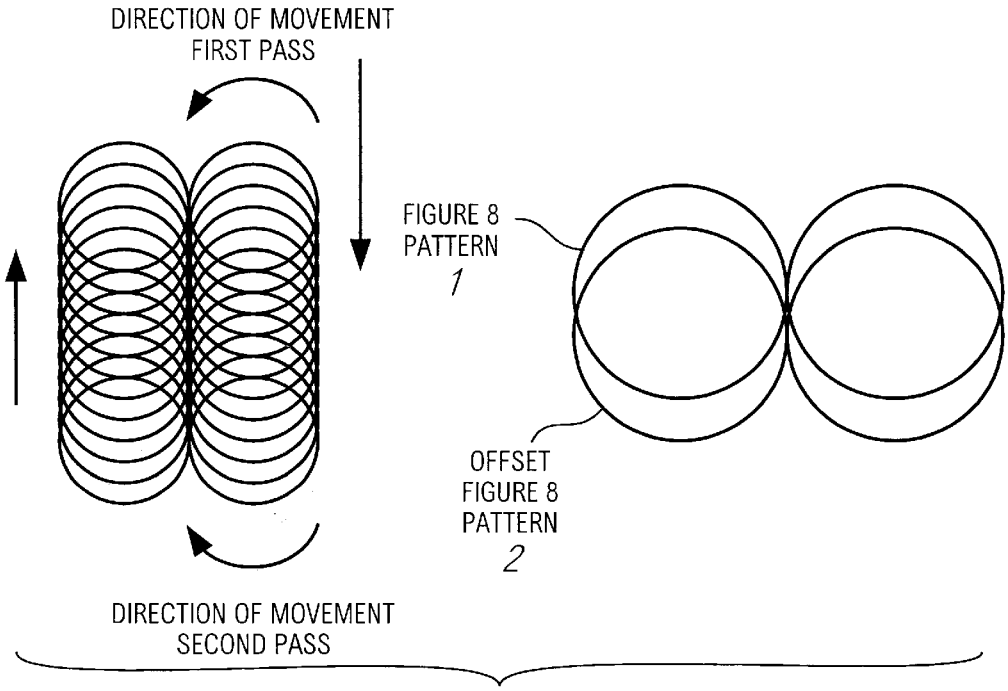
FIG. 3 is a pictorial description of the direction of movement of the computer programmed Figure 8 polishing pattern of the process portion of the invention.

As illustrated by FIGS. 1 and 2 the layout of the polishing apparatus allows the use of all the space on the polishing surface. By using a rectangular array we can space connectors at 1" intervals and create an array which can be expanded to as many as 200 connectors to be polished simultaneously. Polishing machines now in use do not allow for this type of expansion in that they can only place the connectors in the outermost edges of the polishing plate. As illustrated by FIG. 3 the polishing apparatus can accurately produce a constant and perfect Figure 8 polishing pattern—and move this pattern in any direction—by using the invention's computer controlled x-y motion control process with circular interpolation.

FIG. 1 describes the following components of the polishing apparatus:

The polisher includes a casino 13. Installed within said casing is an x-stage 1, a y-stage 2, an interface plate 12, a base plate 5, motor drives 6, a power supply 11, an x-y controller 7, an x-motor 15, and a y-motor 14.

The x-stage 2 is mounted to the casing 13, the y-stage 1 is mounted to the x-stage 2, the interface plate 12 is mounted to the y-stage 1, the base plate 5 is mounted to the interface plate 12. These items comprise the mechanical components for the motion system.

The x-stage 2 and the y-stage 1 are moved via a motor attached to each stage. The y-motor 14 is attached to the y-stage 1, and moves the stage in the y-axis by a ball screw mechanism built into the stage. The x-motor 15 is attached to the x-stage 2 and moves the x-stage 2 in the x-axis.

The y-stage 1 and the x-stage 2 are controlled by means of an x-y controller 7 and motor drives 6 which are powered by a power supply 11. The controller 7 is a computer controlled motion system which can be programmed for all types of movement.

FIG. 2 describes the following components of the polishing apparatus:

The interface plate 12 is attached to the y-stage 1 as a receiving mechanism for the base plate 5 which is the polishing surface for operation of the polisher apparatus. Different polishing surfaces can be attached to the base plate 5 for the polishing process. These surfaces include such polishing mediums as diamond, aluminum oxide, and silicon carbide polishing papers and other coated plates and pads.

The polishing plate 3 is set on the fixed locating members 4 so that the exposed surface of the component to be polished is touching the polishing surface which is applied to the base plate 5. Weights 16 are then applied to the top surface of the polishing plate 3 to supply the correct amount of pressure to the component to be polished. The pressure may also be applied via a pneumatic pressure control system.

The process is controlled by a timer 10, a start switch 9 and a stop switch 8. The amount of time to polish is set on the timer. The process is started by pressing the start switch 9. The polishing process can be stopped at any time by pressing the stop switch 8.

FIG. 3 describes, pictorially, the operation of the Figure 8 polishing process:

The Figure 8 pattern 1 is created by computer programming the x-y motion process to move in a clockwise circle starting from the center of the Figure 8, then moving in a counter clockwise circle to finish the Figure 8 pattern. The offset Figure 8 pattern 2 is created by moving the Figure 8 pattern 1 down a small amount (approximately 0.050"). This pattern is repeated several times to a specified distance. Upon completion of this movement the Figure 8 pattern 1 is reversed. It then moves in the opposite direction 3 and continues until it reaches a specified distance. The whole process is repeated as many times as needed to perform the desired amount of time set by the timer (see 10, FIG. 1.). By combining these patterns the process creates a continuous Figure 8 movement which enables the polishing surface of the polishing apparatus to provide the optimum quality polishing, simultaneously, of not less than 48 fiber optic connectors or similarly configured industrial components.

Textual Description of the Computer Program for the Figure 8 Pattern Process

The following is a copy of the Computer Program for the Figure 8 pattern:

```
DEL R: required to overwrite existing program R
DEF R
PSCLD 15
PSCLA2
PSCLAV2
PAD1.3000
PA1.5000
COMEXL.11
DRFLVL11
L30
PARCOP0,0,-6000,0
PARCOMO,0,6000,0
PLINO,-400
LN
pad0.6
PARCOP0,0,-6000,0
PARCOM0,06000,0
END
DEL F: required to overwrite existing program F
DEF F
PSCLD15
PSCLA2
PAD1.3000
PAI.5000
PVI.5000
DRFLVL11
COMEXL11
L30
PARCOP0,06000,0
PARCOM0,0-6000,0
PLIN0,400
LN
pad0.6
PARCOP0,6000,0
PARCOM0,0,-6000,0
END
DEL Q: required to overwrite existing program Q
DEF Q
ZERO
PRUNF
PRUNR
prunf
prunr
prunf
prunr
END
DEL ZERO: required to overwrite existing program ZERO
DEF ZERO
comex11,1
A1.0000,1.0000
V1.0000,1.0000
AD.3000,.3000
D50000,50000
GO
D-15000,-26000
GO
END
del setup
def setup
comexs2
COMEXL11
DRFLVL11
INFEN1
INLVL111111111111111111111111111111111
INFNC1-D
INFNC2-4p
INFNC3-p
INSELP2,50
startp setup
end
DEL START: required to overwrite existing program START
DEF START
Q
END
PCOMP R
PCOMP F
PCOMP START
PCOMP SETUP
```

While there is shown and described a present preferred embodiment of the invention, it is to be distinctly understood that the invention is not limited thereto, but may be variously embodied and practiced within the scope of the claims which follow:

I claim:

1. A polishing machine, comprising:

a first stage including a first mounting member and a first staging member supported on the first mounting member for reciprocal movement along a first path, a second stage including a second mounting member supported on the first staging member and a second staging member supported on the second mounting member for reciprocal movement along a second path in angular relation to the first path, a polishing member mounted on the second staging member, and a drive mechanism operable to simultaneously reciprocate the first and second staging members along their respective paths so that the polishing member traces a predetermined pattern.

2. The polishing machine of claim 1, wherein the paths of movement of the first and second staging members are rectilinear.

3. The polishing machine of claim 1, wherein the first path is an x-axis, wherein the second path is a y-axis substantially perpendicular to the x-axis.

4. The polishing machine of claim 3, wherein the speed of movement of the one staging member is a multiple of the speed of movement of the other staging member.

5. The polishing machine of claim 4, wherein the multiple is 2.

6. The polishing machine of claim 1, wherein the pattern is a figure eight.

7. The polishing machine of claim 1, wherein the first mounting member is mounted for reciprocal movement along a third path.

8. The polishing machine of claim 1 wherein the drive mechanism is computer controlled.

9. A polishing machine, comprising:

a support, a first stage including a first track mounted on the support and a first staging member supported on the track for reciprocal rectilinear movement along an x-axis, a second stage including a second track mounted on the first staging member and a second staging member mounted on the second track for reciprocal rectilinear movement along a y-axis perpendicular to the x-axis, a polishing member mounted on the second staging member, and a drive mechanism connected to the first and second staging members for reciprocating the staging members along their respective axes so that the polishing member traces a closed arcuate pattern.

10. The polishing machine of claim 9, wherein the stroke of one of the members is a multiple of the stroke of the second member.

11. The polishing machine of claim 10, wherein the multiple is 2.

12. The polishing machine of claim 9, wherein the pattern is a figure eight.

13. The polishing machine of claim 9, wherein the first track is mounted on the support for reciprocal movement along a third axis substantially parallel to one of the x- and y-axes.

14. The polishing machine of claim 9 wherein the drive mechanism is computer controlled.

* * * * *

UNITED STATES PATENT AND TRADEMARK OFFICE

CERTIFICATE OF CORRECTION

PATENT NO. : 5,947,797
DATED : September 7, 1999
INVENTOR(S) : MIKE BUZZETTI

It is certified that error appears in the above-identified patent and that said Letters Patent is hereby corrected as shown below:

In the TITLE:

Change the title to read --COMPUTER-CONTROLLED METHOD AND APPARATUS FOR POLISHING--.

Signed and Sealed this

Eighteenth Day of April, 2000

*Attest:*

Q. TODD DICKINSON

*Attesting Officer*

*Director of Patents and Trademarks*